United States Patent [19]

Granström

[11] 4,363,653

[45] Dec. 14, 1982

[54] METHOD AND APPARATUS FOR MELTING SOLID PIECES OF METAL

[75] Inventor: Staffan Granström, Vasterås, Sweden

[73] Assignee: ASEA Aktiebolag, Vasterås, Sweden

[21] Appl. No.: 256,138

[22] Filed: Apr. 21, 1981

[30] Foreign Application Priority Data

Apr. 22, 1980 [SE] Sweden ..... 8002993

[51] Int. Cl.[3] ..... C21C 5/52

[52] U.S. Cl. ..... 75/10 R; 75/12; 75/63

[58] Field of Search ..... 75/10-12, 75/445, 63; 13/26

[56] References Cited

U.S. PATENT DOCUMENTS 3,734,720 5/1973 Starck ..... 75/63

3,948,642 4/1976 Gross ..... 75/12

*Primary Examiner*—P. D. Rosenberg

*Attorney, Agent, or Firm*—Kenyon & Kenyon

[57] ABSTRACT

Solid pieces of metal, such as steel scrap and ferrous pellets, are charged in a basin having a refractory inside and progressively melted down by an electric induction heater positioned above the basin and the charge. As melt collects in the bottom of the basin it is continuously or intermittently tapped into a storage container having heating means for keeping the melt molten. This prevents the melt level in the basin's bottom from rising uncontrollably.

12 Claims, 5 Drawing Figures

METHOD AND APPARATUS FOR MELTING SOLID PIECES OF METAL

BACKGROUND OF THE INVENTION

For making steel, solid pieces of ferrous metal such as scrap, pellets, etc., are melted down to form a melt which can be worked to the composition and characteristics desired for casting.

When the working is done by the ASEA-SKF practice, the melt is poured into a ladle furnace, of which there may be more than one, the ladle furnace being crane-carried and inserted in an AC induction coil for stirring, the ladle shell being non-magnetic. A roof is provided which can be lowered on the ladle and through which arcing electrodes project for adding heat to the melt, and also there is a cover which can be lowered on the ladle's top and evacuated for degassing the melt. In this way additions can be stirred into the melt, the melt can be further heated, and if desired, finally degassed. The ladle can be used for casting in the same way any steel ladle is used. This practice is disclosed by British specification No. 1,112,876.

To supply the melt required, it is most customary to charge steel scrap, pellets and possibly other solid ferrous pieces into an electric arc furnace having powered arcing electrodes, the arcs boring down into the pieces until ultimately a complete melt-down is effected. During this melt-down, there is arcing from piece to piece of the solid metal which produces concussions and smoke while introducing disturbances in the electrical network supplying the arcing electrode power. The furnace hearth and wall linings are subject to extremely high temperatures and erosion and must be repaired or replaced frequently. The arcing electrodes are consumable, and their cost of replacement is high. It is desirable to provide some better way for effecting a melt-down.

One other way is by the use of a crucible electric AC induction furnace, but this is time-consuming because it cannot be used with the same high power concentrations as can an arc furnace. When used for a melt-down, a crucible induction furnace is particularly sensitive to crucible leakage which damages its induction coil or coils and causes an expensive shutdown.

The object of the invention described below is to provide a better way for effecting a melt-down of solid pieces of metal so as to form a melt.

SUMMARY OF THE INVENTION

According to the invention, the solid pieces of metal for the melt-down are charged in a basin having a refractory inside. An electric AC induction heater is positioned above the basin and the charged pieces and operated so as to induce a heating AC current field in the pieces causing them to progressively melt and form a melt continuously collecting in the bottom of the basin. To avoid disturbances in the AC power supplied to the induction heater, the latter can be moved up and down and/or the level of the collecting melt controlled to keep the heating AC current field induced in the pieces and the collecting melt at a substantially constant impedance.

To prevent the collecting melt in the basin's bottom from progressively increasing in height, the melt can be continuously or intermittently tapped from the basin and into a refractory lined storage container, preferably provided with a heating means keeping the melt molten. For this the ladle furnace of the ASEA-SKF process can be used with a roof supplied with electric arcing electrodes used continuously or as required to keep the melt in the ladle molten. The arc power required is much less than is required for a melt-down using arcs.

The basin used can be relatively shallow as compared to its horizontal extent and may be provided with a lid in which the inductive heater is installed or connected so that the lid and heater form a unit bodily movable vertically and from over the basin for charging of the basin. The basin may be made with a tap hole provided with means for maintaining a relatively shallow pool in the basin's bottom, the basin being made so it can be tipped towards this tap hole for slag removal.

The basin can be made so that the heat losses are small. Because the basin's side wall need not be as high as the side wall of any usual melt-down furnace, the basin's side wall can be made with an unusually thick refractory lining providing unusually effective thermal insulation and, therefore, low heat loss. The level of the melt collecting in the basin's bottom can be kept low because the collecting melt can be continuously tapped into the storage ladle, so a high power concentration is possible without causing extensive molten metal flow due to the induction current. The induction heater itself with its coils and electrical equipment is not influenced by wear of the basin's lining because it is above the ladle and free from all molten metal. There is substantially no noise caused by the melt-down and there is very little if any production of gas. Assuming that for storage the ASEA-SKF type of ladle is used with a cover provided with arcing electrodes, the arcs are struck not with solid pieces of metal but with the melt collecting in the ladle via continuous or substantially continuous tapping of the melt collecting in the basin's bottom. Only a small amount of power is required to keep the collecting melt molten, and, therefore, the arcing electrode power and wear are small and little or no smoke or gases are produced.

When the ladle furnace is full, it can be crane-carried to the usual ASEA-SKF processing stations while a second replacement ladle continues to receive the melt tapped from the melt-down basin. The roof and its arcing electrodes used for the ladle storing the melt tapped from the basin, need not be the same as is used for the working of the melt, the heating requirement being low.

DESCRIPTION OF THE DRAWINGS

The accompanying drawings schematically illustrate the principles of the invention, the various views being as follows.

DETAILED DESCRIPTION OF THE INVENTION

Figure 1:
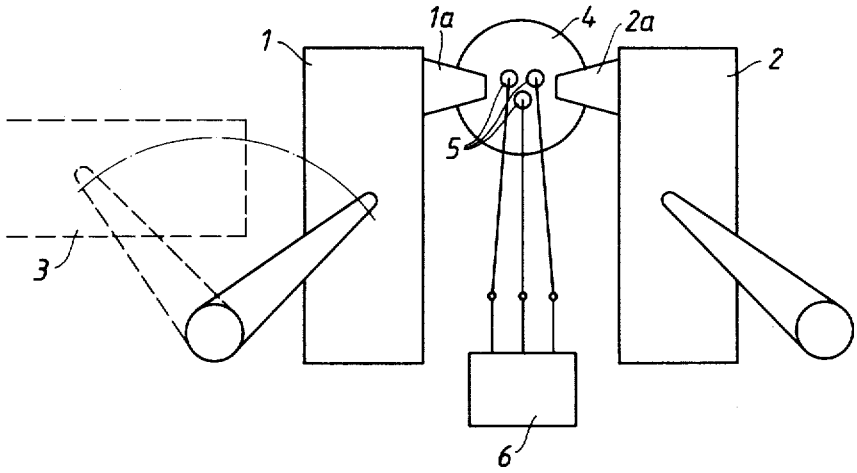
FIG. 1 is a plan view showing by outline diagram how two of the melt-down basins can be used in parallel.

In FIG. 1 the outline diagram shows how two of the melt-down basin furnaces 1 and 2 can be positioned in parallel. The lid of each should be removable and provided with equipment for not only moving it up and down, but also to one side to permit charging of the basin as is illustrated by the broken lines 3 in the case of the basin 1. Both basins are shown with oblong rectangular shapes and their side walls which face each other are provided with tapping means 1*a* and 2*a* respectively for intermittently or continuously delivering the progressively forming melts from the basins to the ladle furnace 4 provided with a roof having arcing electrodes 5 powered by a source of electric power 6. When one of the basins is used for a melt-down, the other can be charged so that a continuous supply of melt can be delivered to the ladle furnace 4.

Figure 2:
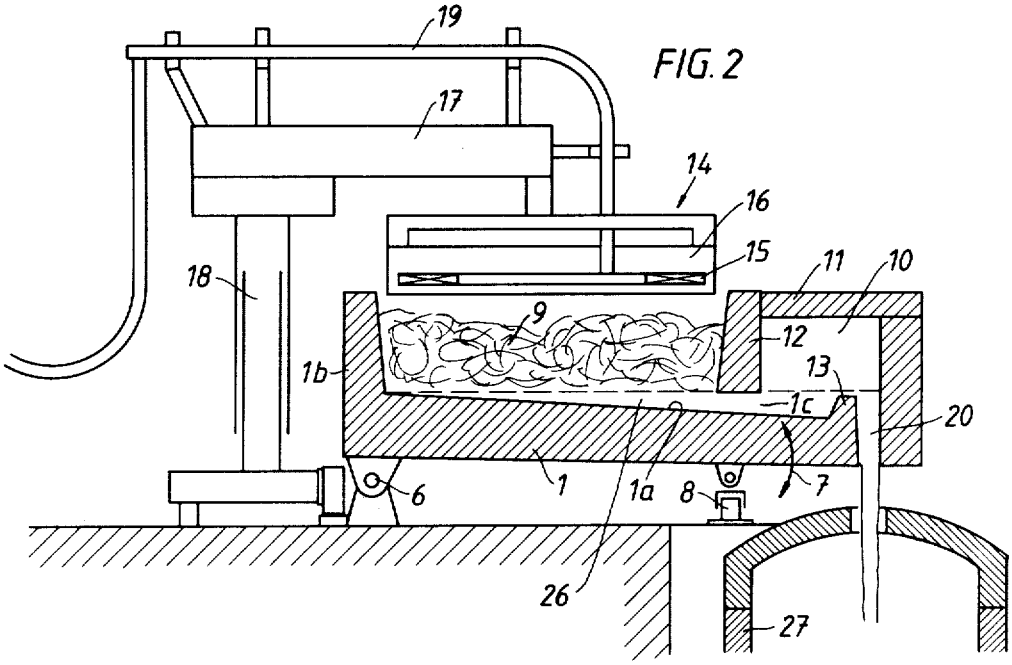
FIG. 2 is a vertical cross section of one of the units.

In FIG. 2 the tapping ends of the basin 1 is shown in vertical cross section. Its left-hand side is pivotally mounted at 6 so that the basin can tilt by swinging as indicated by the arrow 7, using a hydraulic lifter 8. The basin's bottom 1*a* slopes or declines towards the right. The basin's side wall 1*b* does not extend upwardly very far and without excessive cost it as well as the basin's bottom can be lined thickly, but the basin's extent in the horizontal direction can be substantially greater. It is because of these unique dimensions that the term "basin" has been used.

The right-hand side wall 12 of the basin has a tap hole 1*c* and the melt collecting from the melting charge 9 runs down the sloping bottom 1*a* of the basin towards and through the horizontal tap hole 1*c* into a slag separator 10 having a possibly removable cover 11. The basin side wall 12 above the tap hole 1*c* serves to hold back the unmelted solid part of the charge and the slag floating on the collecting melt beneath the charge, while inside of the slag separator 10 a dam 13 is provided which performs two functions. When the basin 1 is positioned with its bottom 1*a* horizontal, the dam 13 keeps the melt level at a height fixed by the dam's height, and, secondly, for deslagging when the basin 1 is tilted as shown in FIG. 2, the same holds back the melt while permitting the floating slag to run over the top of the dam and into a slag ladle. The operating temperature need be only a little above the melting temperature of the charge 9 so not very much slag should be expected.

The lid or roof assembly is shown at 14 with the inductor coil or coils 15 and core 16 connected together with the lid to form a unit. This unit should be refractory in nature, and because of its elongated oblong shape fitting the contour of the basin, is called a lid. The induced field in the charge can be spread uniformly over the entire charge in the basin by proper design of the inductor coil or coils and core structure.

This lid assembly is removable from the basin and is supported by a cantilever 17 which can be moved up and down by a hydraulically powered lifting column 18 which is pivotal to provide the action illustrated by the broken lines 3 in FIG. 1. The cantilever 17 can also mount the power lines 18 for the inductor coil or coils 15.

The slag separator 10 is itself provided with a vertical tap hole 20 through which normally the collecting melt pours downwardly. In FIG. 2 the deslagging operation is illustrated.

Figure 3:
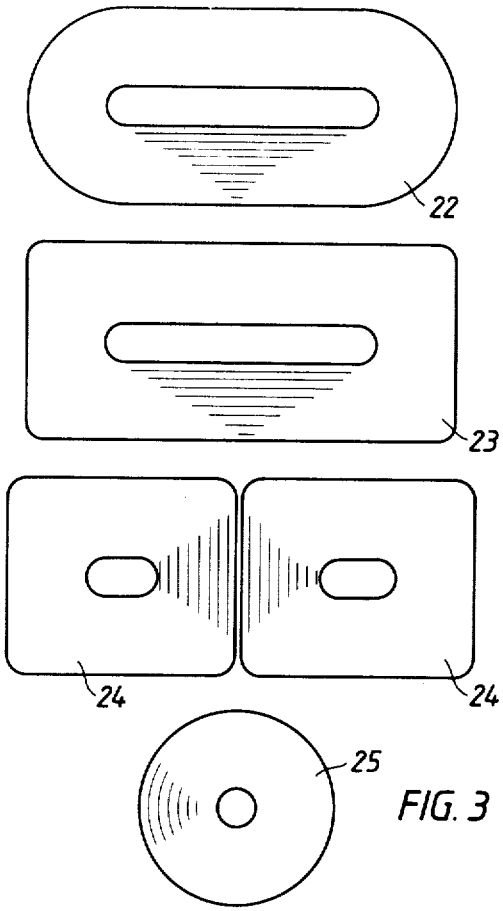
FIG. 3 shows the outlines of several different contours of induction coils which may be used above the basin.

Various contours may be used for the design of the induction coil or coils 15, FIG. 3 showing at 22 an elongated form having rounded ends, at 23 showing an elongated rectangular form or oblong, and at 24 showing how two squares can be used, 25 showing a circular coil. In the case of the illustrated elongated basin shape, one of the designs shown at 22 through 24 would usually be used, but the single coil shown at 25 might be used in some instances.

Returning to FIG. 2 showing the basin tilted, the melt with slag floating on it is shown at 26, the dam 13 permitting the slag to skim or run off from the top of the melt for discharge into a slag ladle 27. Deslagging can be done when the ladle furnace shown in FIG. 1 is filled and carried away. After deslagging, another ladle furnace can take the place of the filled one.

To exemplify the practice of the new melt-down method, it is to be assumed that in FIG. 2 the basin 1 is lifted so its bottom is in its horizontal position, and that any of the usual kinds of scrap and possibly pellets are loaded in the furnace to form the charge 9, the lid or roof 14 being swung clear from the basin's top for this charging. With the lid moved back and lowered over the charge 9, using the manipulating equipment described before, power is turned on and the inductive heating of the charge starts. Inherently there can be practically no noise and little, if any, smoke. The solid pieces of metal gradually melt and begin to form the melt which as soon as it exceeds the height of the dam 13, begins to run off via the tap hole 20 in the slag removal chamber or spout 10, the basin wall 12 above the horizontal tap hole 1*c* holding back the as yet unmelted part of the charge and any slag.

At this time the furnace ladle 4 is positioned below the vertical tap hole 20 so as to receive the melt as it forms. Tapping should proceed so as to keep the melt in the basin bottom at a low level preventing the formation of meniscus or surface convexity which would cause variations in the impedance of the current induced in the charge. Raising and lowering of the lid 14 and its inductor unit can keep the impedance of the field induced in the charge and melt at a relatively constant value avoiding disturbances in the electric power supply.

The melt collecting in the ladle furnace shown at 4 in FIG. 1 is kept molten by the use of that furnace's roof electrodes 5 as required, but the arcing power used need only be sufficient to keep the collection of melt stored safely molten. Small arcing power is required for this purpose, and the arcs are struck with a melt and not solid pieces of metal, thus avoiding the usual noise and smoke, fumes and/or gases associated with a melt-down of solid pieces in an arc furnace.

When two of the basins are used in parallel, they can be alternately operated as previously indicated, permitting deslagging and/or charging of one while the other continues in operation. The ladle furnace roof can, if desired, be a permanent part of the entire installation so that a filled ladle can be quickly removed and transported, while another takes its place and uses the same roof.

Figure 4:
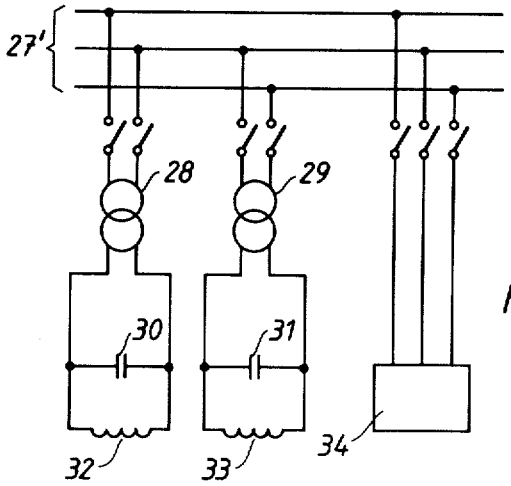
FIG. 4 diagrammatically shows how the inductor coils can be powered by means of separate transformers.

In the foregoing manner a substantially continuous melt-down can be carried out. In the diagram of FIG. 4 the inductor power supply is from a three-phase network 27' via separate transformers 28 and 29 with parallel capacitors 30 and 31, to the inductors 32 and 33 in the lid or roof of the melt-down furnace basin. These may be like the inductors 24 in FIG. 3. Symmetrization and compensation can be effected via thyristor-connected capacitors and reactors in the box shown at 34.

Figure 5:
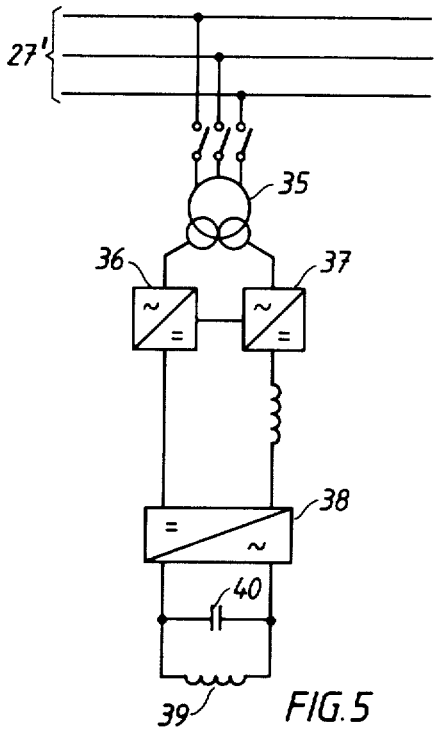
FIG. 5 diagrammatically shows the use of AC converters.

FIG. 5 shows the supply with self-converting converters from a three-phase network 27'. The supply takes place via a transformer 35 and two parallel-working rectifiers 36 and 37 and an inverter 38, the output side of which feeds the inductor 39 which is provided with a parallel capacitor 40. It is thus possible to select any desired frequency for feeding the inductor 39. In this case the inductor can be wound as shown at 22, 23 or 25 in FIG. 3. With several inductor coils the supply is suitably carried out with individual single-phase transformers as shown in FIG. 4.

Although the apparatus and method of this invention is primarily intended for effecting a melt-down, it is conceivable that alloying may occur during the melt-down. For example, by selection of scrap together with possibly the use of iron pellets, alloying may be possible.

What is claimed is:

1. A method for melting solid pieces of metal, comprising charging said pieces in a basin having a refractory inside, and downwardly inductively heating the pieces in the basin by an electric AC induction heating means positioned above the basin and the pieces and so as to induce an AC current field in the pieces heating and progressively melting the pieces into a melt collecting in the basin's bottom.

2. The method of claim 1 in which said means is moved vertically so as to keep the electrical impedance of said field at a substantially constant value.

3. The method of claim 1 in which the collecting melt is tapped from the basin so as to keep the melt's top level low enough to prevent it from being forced into a meniscus affecting the electrical impedance of the field.

4. The method of claim 1 in which said means is controlled so as to keep the temperature of said melt close to the melting temperature of said pieces of metal.

5. The method of claims 1, 2, 3 or 4 in which said melt collecting in the basin's bottom is tapped into a ladle furnace and by heating stored therein while heated by the ladle furnace so as to be kept molten.

6. An apparatus for melting solid pieces of metal, comprising a basin having a bottom portion with a refractory inside which is adapted to contain a charge of said pieces, and an electric AC induction heater positioned above said basin and pieces when charged in the basin's bottom portion so as to induce a heating AC current field in the pieces causing them to progressively melt and form a melt collecting in said bottom portion.

7. The apparatus of claim 6 in which said basin has an open top having a lid to which said heater is connected, said lid being removable and having means for moving it to positions respectively where said top is free to receive said pieces and where the lid is over said top.

8. The apparatus of claim 6 in which said heater has means for raising and lowering the heater.

9. The apparatus of claim 6 in which said bottom portion includes a side wall in which a tap hole is formed and is tiltable towards and from the tap hole, the latter connecting with a bottom pouring means for limiting flow of said melt through the tap hole so as to maintain a predetermined level of the melt in the basin's said bottom portion.

10. The apparatus of claim 9 in which is included a portable furnace ladle means for receiving and collecting said flow.

11. A method for melting solid pieces of metal or metal alloys, comprising charging said pieces in a basin having a refractory inside, and downwardly inductively heating the pieces in the basin by an electric AC induction heating means positioned in a cover for closing said basin upwards in closed position, said AC induction heating means inducing an AC current field in the pieces and therewith heating and progressively melting the pieces into a melt collecting in the basin's bottom, from which it is tapped into a separate heat retaining receptacle.

12. An apparatus for melting solid pieces of metal or metal alloy, comprising a basin having a bottom portion with a refractory inside which is adapted to contain a charge of said pieces, and an electric AC induction heater arranged in a cover positioned above said basin and pieces and arranged to close said basin upwards when applied upon the same, said heater being arranged to induce a heating AC current field in the pieces causing them to progressively melt and form a melt collecting in said bottom portion, members in said basin to tap said melt into heat retaining receptacles.

* * * * *